US011484461B2

(12) United States Patent
Furutani

(10) Patent No.: US 11,484,461 B2
(45) Date of Patent: Nov. 1, 2022

(54) CHAIR-TYPE MASSAGER

(71) Applicant: Fuji Medical Instruments Mfg. Co., Ltd., Osaka (JP)

(72) Inventor: Takeshi Furutani, Osaka (JP)

(73) Assignee: Fuji Medical Instruments Mfg. Co., Ltd., Osaka (JP)

( * ) Notice: Subject to any disclaimer, the term of this patent is extended or adjusted under 35 U.S.C. 154(b) by 350 days.

(21) Appl. No.: 16/789,922

(22) Filed: Feb. 13, 2020

(65) Prior Publication Data

US 2020/0405568 A1 Dec. 31, 2020

(30) Foreign Application Priority Data

Jun. 28, 2019 (JP) ..... JP2019-121112

(51) Int. Cl.
*A61H 7/00* (2006.01)
*A47C 7/62* (2006.01)
*A61H 1/00* (2006.01)

(52) U.S. Cl.
CPC ..... *A61H 7/00* (2013.01); *A47C 7/62* (2013.01); *A61H 1/00* (2013.01); *A61H 2201/0149* (2013.01); *A61H 2201/0192* (2013.01); *A61H 2201/0207* (2013.01); *A61H 2201/10* (2013.01);
(Continued)

(58) Field of Classification Search
CPC ..... A61H 7/00; A61H 2201/0149; A61H 2201/0192; A61H 2205/06; A61H 1/00; A61H 1/006; A61H 1/008; A61H 9/0078; A61H 23/00; A61H 7/002; A61H 7/004; A61H 7/007; A61H 23/006; A61H 23/02; A61H 15/0078; A61H 2201/0138; A61H 2201/0142; A61H 2201/0146; A61H 2201/1633; A61H 2201/0207; A61H 2201/10; A61H 2201/1238; A61H 2201/0103; A61H 2201/1635; A61H 2205/062; A61H 2205/081; A61H 2205/065; A61H 2205/10;
(Continued)

(56) References Cited

U.S. PATENT DOCUMENTS 9,072,648 B2 * 7/2015 Lev ..... A61H 9/0078
9,107,508 B2 * 8/2015 Ishikawa ..... A47C 7/5068
9,326,608 B1 * 5/2016 Hoy ..... A47C 1/0345
(Continued)

FOREIGN PATENT DOCUMENTS

JP 2003-260099 A 9/2003

*Primary Examiner* — Samchuan C Yao
*Assistant Examiner* — Tyler A Raubenstraw
(74) *Attorney, Agent, or Firm* — Masuvalley & Partners; Peter R. Martinez

(57) ABSTRACT

In a chair-type massager, a backrest portion includes a back frame, a pair of arm treatment portions, a support frame having a pair of support portions and a beam portion, and an actuator moving the support frame. The support portions are provided on the left and right sides, respectively, of the back frame and supports the arm treatment portions respectively. The beam portion extends from upper end parts of the support portions toward the back frame along the left-right axis. The actuator has a rod portion and a drive portion. The rod portion is connected to one of the back frame or the beam portion of the support frame, on the other of which the drive portion is pivotably supported. The drive portion is configured to move up and down the rod portion.

5 Claims, 12 Drawing Sheets

(52) U.S. Cl.
CPC .. *A61H 2201/1238* (2013.01); *A61H 2205/06* (2013.01)

(58) Field of Classification Search
CPC ..... A61H 2205/125; A47C 7/62; A47C 7/54; A47C 7/541; B60N 2/77
See application file for complete search history.

(56) References Cited

U.S. PATENT DOCUMENTS 9,622,935 B2 * 4/2017 Fukuyama ..... A61H 23/006
2002/0003360 A1 * 1/2002 Maier ..... A47C 9/002 297/35
2008/0132383 A1 * 6/2008 Einav ..... A61H 23/0263 482/8
2010/0259085 A1 * 10/2010 Lindell ..... A61G 5/1067 297/354.1
2011/0275968 A1 * 11/2011 Liu ..... A61H 7/007 601/134
2012/0292955 A1 * 11/2012 van Zyl ..... B60N 2/38 297/188.04
2015/0216759 A1 * 8/2015 Tamaki ..... A61H 7/007 601/134
2016/0317378 A1 * 11/2016 Fujishiro ..... A61H 9/0078
2017/0340856 A1 * 11/2017 Inada ..... G16H 20/30
2017/0360641 A1 * 12/2017 Nakata ..... A61H 15/0078

* cited by examiner

CHAIR-TYPE MASSAGER

RELATED APPLICATIONS

This application is based on Japanese Patent Application No. 2019-121112 filed on Jun. 28, 2019, the contents of which are hereby incorporated by reference.

BACKGROUND OF THE INVENTION

1. Field of the Invention

The present invention relates to a chair-type massager.

2. Description of Related Art

Conventionally there are known chair-type massagers that administer pressing treatment to side parts of the forearms of a treated person by inflating and deflating air bags. For example, according to Japanese Patent Application published as No. 2003-260099, cover portions are provided that extend frontward from left and right side parts of a backrest portion. These cover portions are provided at positions where they cover side parts of the forearms of the treated person when he or she is seated. Inside the cover portions, air bags are provided that press the side parts of the forearms.

Inconveniently, the physical constitution varies from person to person, and accordingly so does the position of the forearms of the treated person seated on a chair-type massager. Thus, according to Japanese Patent Application published as No. 2003-260099, in cases where the treated person has a comparatively high or low sitting height, the position of the air bags along the up-down axis may be below or above the side parts of the forearms. Moreover, depending on the physical constitution of the treated person, the position of the air bags along the front-rear axis may be deviated from the side parts of the forearms. In such cases, the side parts of the forearms may not be subjected to appropriate pressing treatment. Furthermore, according to Japanese Patent Application published as No. 2003-260099, the air bags for pressing the side parts of the forearms are used exclusively for pressing treatment, and novel treatment using those air bags is expected.

SUMMARY OF THE INVENTION

Against the background discussed above, an object of the present invention is to provide a concrete movement mechanism for an arm treatment portion that can press a side portion of the forearm of a treated person.

To achieve the above object, according to one aspect of the present invention, a chair-type massager includes a seat portion and a backrest portion. The seat portion supports the buttocks and thighs of a treated person. The backrest portion is disposed generally upright from the seat portion, and supports the body of the treated person. The backrest portion has a back frame, a pair of arm treatment portions, a support frame, and an actuator. The back frame is the framework of the backrest portion. The pair of arm treatment portions are configured to press side parts of the left and right forearms, respectively, of the treated person. The support frame has a pair of support portions which are provided on the left and right sides, respectively, of the back frame and which support the arm treatment portions respectively. The actuator is configured to move the support frame relative to the back frame. The support frame further has a beam portion. The beam portion extends from upper end parts of the support portions toward the back frame along the left-right axis. The actuator has a rod portion and a drive portion. The rod portion is connected to one of the back frame or the beam portion of the support frame. The drive portion is pivotably supported on the other of the back frame or the beam portion of the support frame, and is configured to move up and down the rod portion.

This and other features and benefits of the present invention will become apparent from the description of embodiments which follows.

DETAILED DESCRIPTION OF PREFERRED EMBODIMENTS

Exemplary embodiments of the present invention will be described below with reference to the accompanying drawings.

Figure 1:
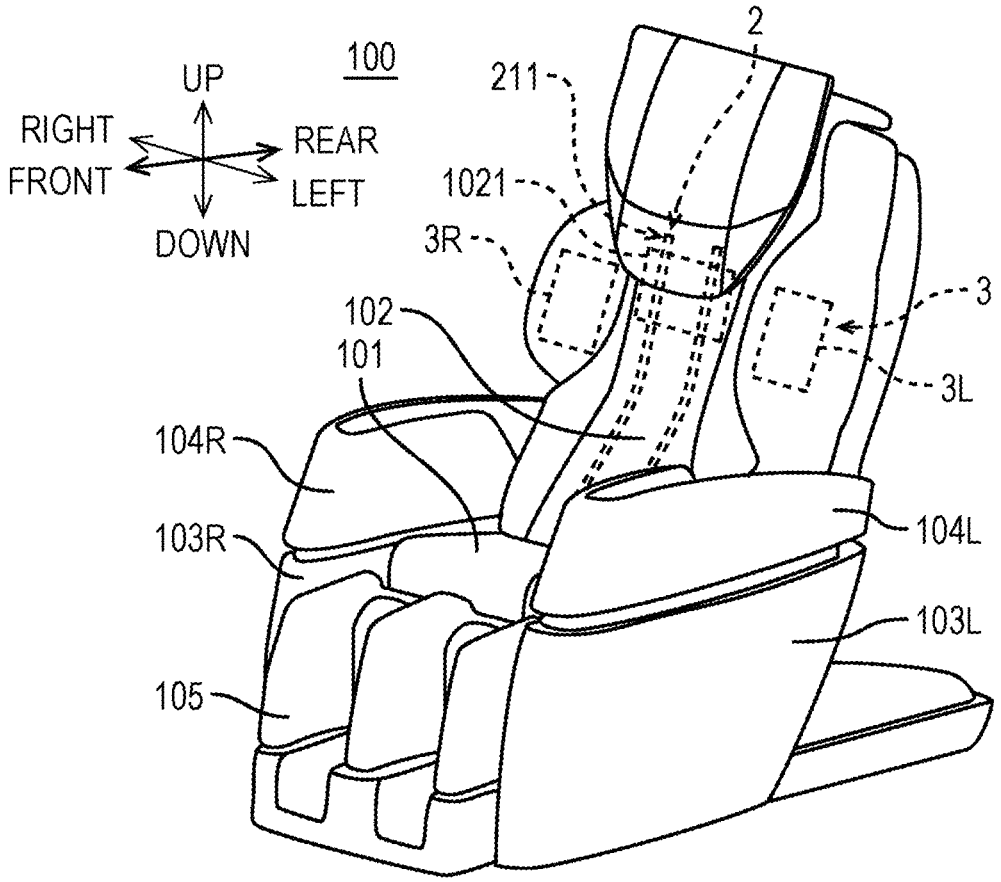
FIG. 1 is a perspective view of a chair-type massager.

FIG. 1 is a perspective view of a chair-type massager 100. In the following description, the chair-type massager 100 will be referred to as the "massager 100".

In the following description, different sides are referred to as follows. The term "front" is used to indicate the front side as seen from a treated person seated on the massager 100 with a backrest portion 102, which will be described later, uncollapsed. The term "rear" is used to indicate the rear side as seen from a treated person seated on the massager 100 with the backrest portion 102 uncollapsed. The term or "upper" is used to indicate the upper side (head side) as seen from a treated person seated on the massager 100 with the backrest portion 102 uncollapsed. The term "lower" is used to indicate the lower side (leg side) as seen from a treated person seated on the massager 100 with the backrest portion 102 uncollapsed. The term "right" is used to indicate the right side as seen from a treated person seated on the massager 100 with the backrest portion 102 uncollapsed. The term "left" is used to indicate the left side as seen from a treated person seated on the massager 100 with the backrest portion 102 uncollapsed.

First Embodiment

First, with reference to FIG. 1, a first embodiment will be described.

Massager

The massager 100 includes a seat portion 101; a backrest portion 102; a pair of, namely left and right, base portions 103L and 103R; a pair of, namely left and right, armrest portions 104L and 104R; and an ottoman 105. The backrest portion 102, the armrest portions 104L and 104R, and the ottoman 105 are attached to a body portion, which includes the seat portion 101 and the base portions 103L and 103R.

The seat portion 101 supports the buttocks and the thighs of the treated person.

The backrest portion 102 is disposed generally upright from the seat portion 101, and supports the head, the body (i.e., torso, e.g., shoulders, back, and lower back), and the like. The backrest portion 102 is attached to the rear end of the seat portion 101 so as to be rotatable about a reclining rotation axis (omitted from illustration) extending along the left-right axis. By pivoting about the reclining rotation axis, the backrest portion 102 can be collapsed rearward. The backrest portion 102 includes a treatment unit 1021 and arm treatment portions 3L and 3R. The treatment unit 1021 is supported by a back frame 2, which will be described later, and administer treatment to the back of the treated person. The treatment unit 1021 engages with a treatment unit engagement portion 211, which will be described later, provided in the backrest portion 102, and is ascendible-descendible along the lengthwise (longer-side) axis of the backrest portion 102. The treatment unit 1021 includes treating elements (omitted from illustration) and a kneading driving mechanism (omitted from illustration), the latter driving the former to perform kneading operation. The arm treatment portions 3L and 3R will be described later.

The base portion 103L is disposed generally upright on the left side of the seat portion 101, and supports the armrest portion 104L. The base portion 103R is disposed generally upright on the right side of the seat portion 101, and supports the armrest portion 104R.

The armrest portion 104L supports the left forearm and the left hand of the treated person, and the armrest portion 104R supports the right forearm and the right hand of the treated person. The armrest portions 104L and 104R are shaped symmetrically left to right. The armrest portions 104L and 104R each have a recess (no reference sign assigned) that is depressed downward. The recess accommodates the forearm and the hand of the treated person. The recess is provided with an air bag (omitted from illustration). As air is supplied and discharged, the air bag inflates and deflates, and thereby massage is administered to the forearm of the treated person. This, however, is not meant as any limitation. The recess can be provided with any treating means other than an air bag, or with no treating means at all.

The ottoman 105 accommodates the lower legs and the feet of the treated person. The ottoman 105 is rotatable about a rotation axis (omitted from illustration) that extends along the left-right axis under an front-end part of the seat portion 101. The ottoman 105 is provided with an air bag (omitted from illustration). As the air bag inflates and deflates, massage is administered to the lower legs and the feet of the treated person.

Control System of the Massager

Figure 2:
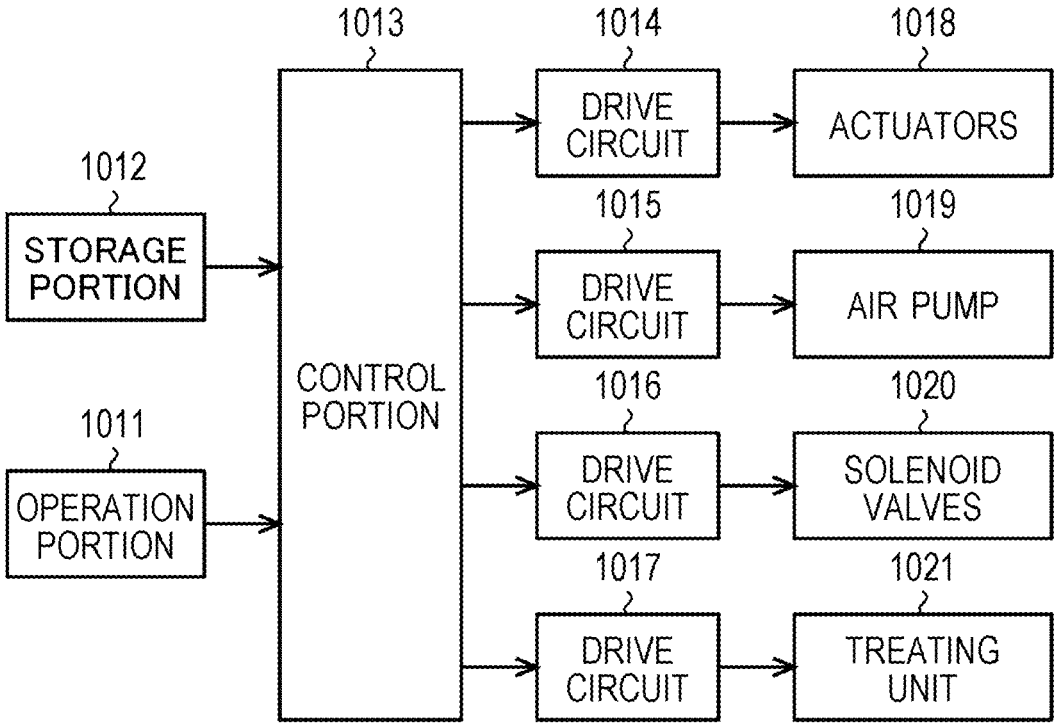
FIG. 2 is a block diagram showing a control system for controlling the operation of a chair-type massager.

Next, an example of the configuration of the control system of the massager 100 will be described. FIG. 2 is a block diagram showing the control system that controls the operation of the massager 100.

The massager 100 includes an operation portion 1011, a storage portion 1012, a control portion 1013, driving circuits 1014 to 1017, a group of actuators 1018, an air pump 1019, a group of solenoid valves 1020, and the already-mentioned treatment unit 1021.

The operation portion 1011 accepts operation and input by the treated person or the like, and feeds the control portion 1013 with signals based on such operation and input.

The storage portion 1012 is a non-transitory storage medium that holds the information stored in it even on failure of the supply of electric power. The storage portion 1012 stores, for example, programs and data that the control portion 1013 needs to control the operation of the massager 100.

The control portion 1013 controls the operation of the massager 100. For example, the control portion 1013 controls the group of actuators 1018 via the driving circuit 1014; the control portion 1013 controls the air pump 1019 via the driving circuit 1015; the control portion 1013 controls the group of solenoid valves 1020 via the driving circuit 1016; the control portion 1013 controls the treatment unit 1021 via the driving circuit 1017.

The group of actuators 1018 includes a plurality of actuators. For example, the group of actuators 1018 includes, among others, a backrest actuator that makes the backrest portion 102 pivot, an ottoman actuator that makes the ottoman 105 pivot, and an actuator that makes a support frame 4, which will be described later, operate.

The group of solenoid valves 1020 includes a plurality of solenoid valves. Some of the solenoid valves are provided between the air pump 1019 and a group of air bags provided in the massager 100 to switch the intervening passages between a communicating state and a shut-off state. The group of air bags includes, for example, air bags provided in the armrest portions 104L and 104R and the like as well as the previously mentioned air bags used as the arm treatment portions 3L and 3R. Some other of the solenoid valves are provided between the group of air bags and the outside to switch the intervening passages between a communicating state and a shut-off state. For example, when a solenoid valve so operates that the air pump 1019 communicates with an air bag, air is supplied from the air pump 1019 via the solenoid valve to the air bag so that the air bag inflates. For another example, when another solenoid valve so operates that an air bag communicates with the outside, the air inside the air bag is discharged via the solenoid valve to the outside. As the air inside the air bag is discharged, the air bag deflates. For another example, when those solenoid valves so operate that the air bag communicates neither with the air pump 1019 nor with the outside, the air inside the air bag is retained.

Structure of the Backrest Portion

Figure 3:
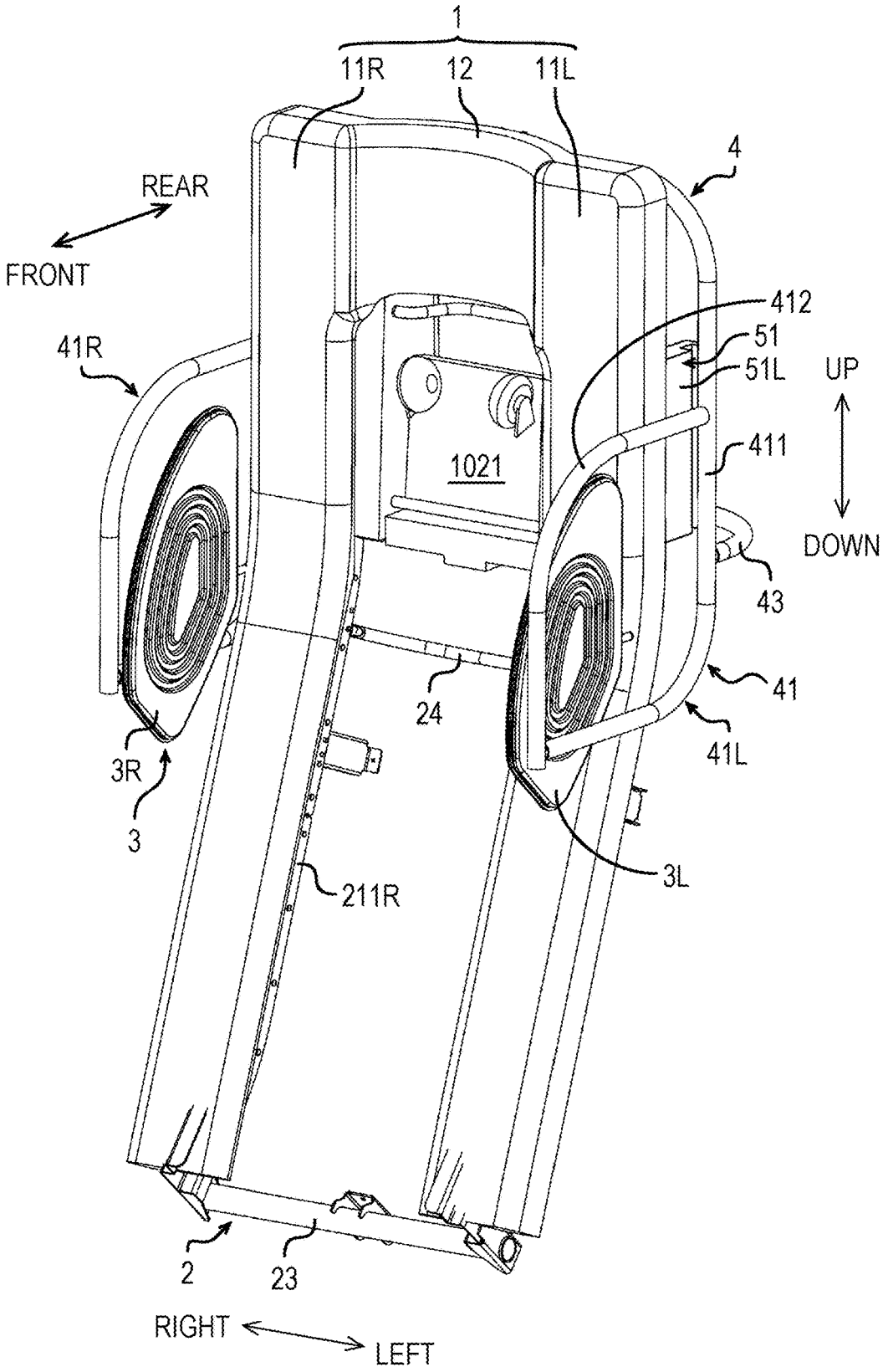
FIG. 3 is a perspective view of a principal part of a backrest portion provided in a chair-type massager according to a first embodiment as seen from obliquely in front.
Figure 4:
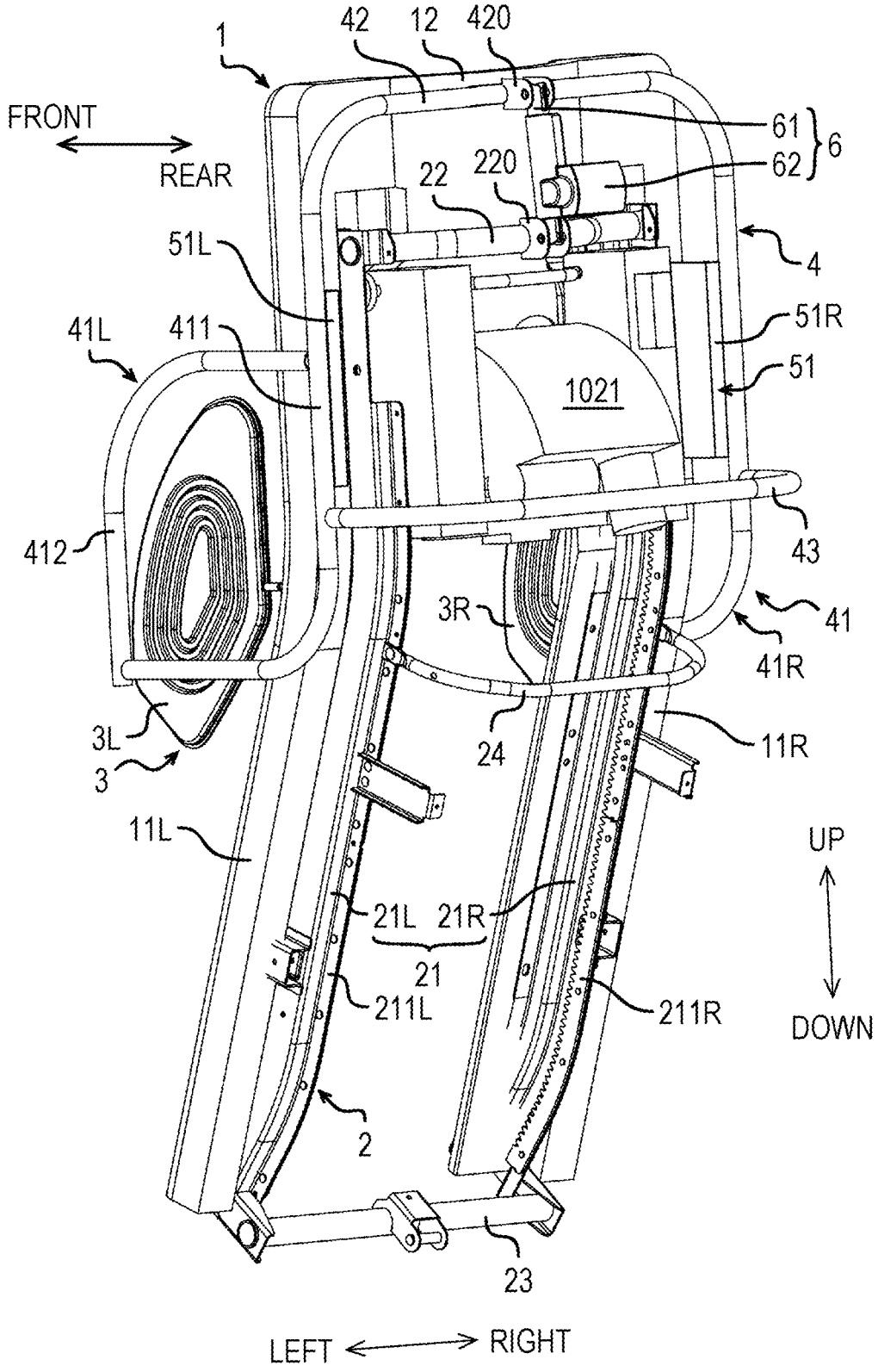
FIG. 4 is a perspective view of the principal part of the backrest portion according to the first embodiment as seen from obliquely behind.
Figure 5:
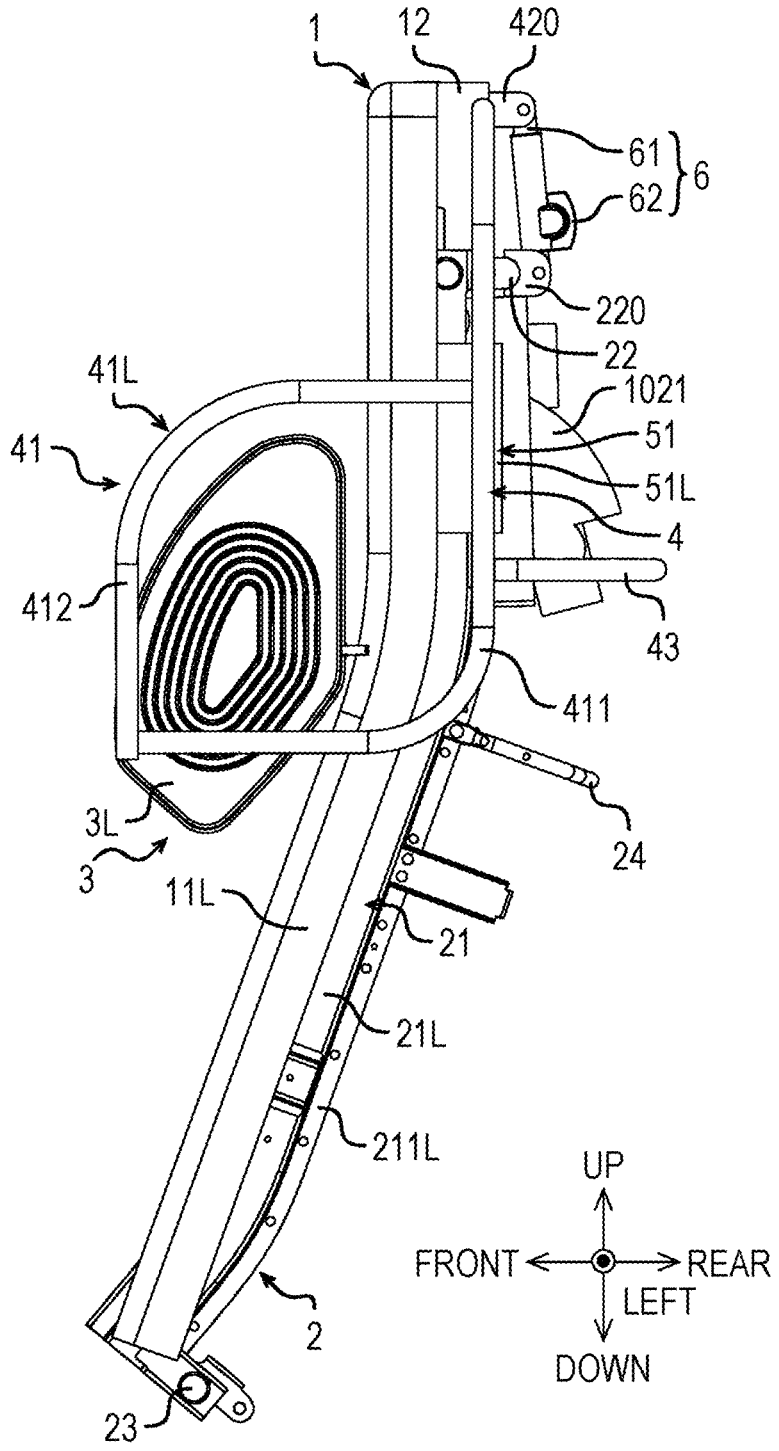
FIG. 5 is a side view showing an example of the operation of the principal part of the backrest portion according to the first embodiment.
Figure 6:
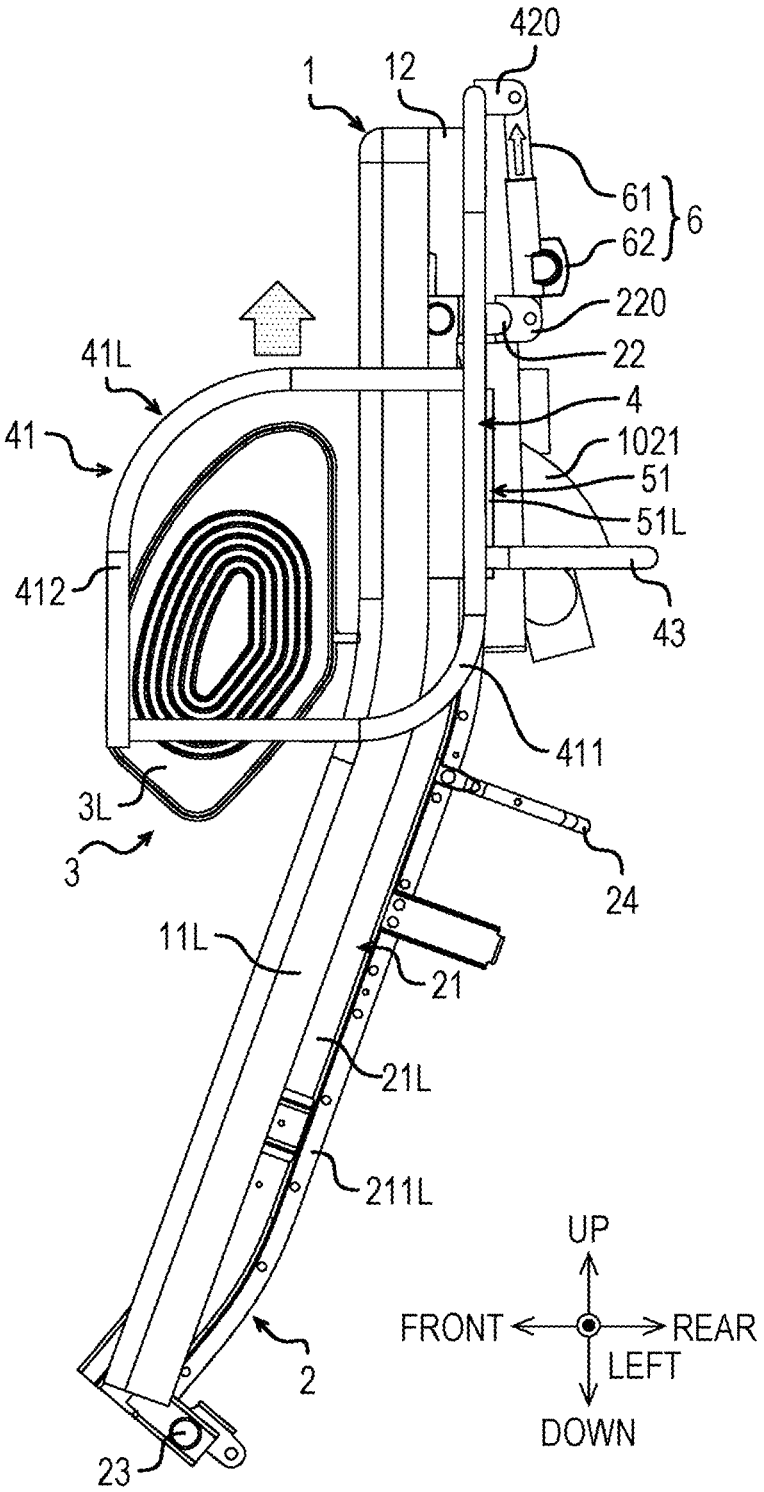
FIG. 6 is a side view showing another example of the operation of the principal part of the backrest portion according to the first embodiment.

FIGS. 3 to 6 are diagrams showing an example of the structure of a principal part of the backrest portion 102 according to the first embodiment. FIG. 3 is a perspective view of the principal part of the backrest portion 102 according to the first embodiment as seen from obliquely in front. FIG. 4 is a perspective view of the principal part of the backrest portion 102 according to the first embodiment as seen from obliquely behind. FIG. 5 is a side view showing an example of the operation of the principal part of the backrest portion 102 according to the first embodiment. FIG. 6 is a side view showing another example of the operation of the principal part of the backrest portion 102 according to the first embodiment. The indications "up", "down", "front", "rear", "left", and "right" in FIGS. 3 to 6 indicate the respective directions with respect to the backrest portion 102 in the uncollapsed state. FIGS. 5 and 6 show the left side of the principal part of the backrest portion 102 according to the first embodiment. FIG. 5 shows a state where a rod portion 61, which will be described later, of an actuator 6 is contracted. FIG. 6 shows a state where the rod portion 61 of the actuator 6 is expanded.

The backrest portion 102 has a base portion 1 made of resin; a cushion portion (omitted from illustration); a back frame 2; a pair of, namely left and right, arm treatment portions 3L and 3R; a support frame 4; support portion guide rails 51L and 51R; and an actuator 6. The arm treatment portions 3L and 3R are occasionally referred to collectively as the "arm treatment portion(s) 3". The support portion guide rails 51L and 51R are occasionally referred to collectively as the "support portion guide rail(s) 51".

The base portion 1 has a pair of, namely left and right, plate portions 11L and 11R, which have a lengthwise axis; and a bridge portion 12. The lengthwise axis of each of the plate portions 11L and 11R runs along the up-down axis, along the lengthwise axis of the backrest portion 102. The transverse (shorter-side) axis of each of the plate portions 11L and 11R runs along the left-right axis. The bridge portion 12 couples together upper-end parts of the plate portions 11L and 11R. The cushion portion is arranged on the front face of the base portion 1. The cushion portion is formed of a material with good shock-absorbing properties such as a hard or soft foamed material.

The back frame 2 is the framework of the backrest portion 102. The back frame 2 has a pair of, namely left and right, upright members 21L and 21R; a treatment unit engagement portion 211, an upper coupling portion 22, a lower coupling portion 23; and a bridge portion 24.

The left upright member 21L is provided on a rear part of the side face of the left plate portion 11L of the base portion 1, and extends along the up-down axis, along the lengthwise axis of the left plate portion 11L. The right upright member 21R is provided on a rear part of the side face of the right plate portion 11R of the base portion 1, and extends along the up-down axis, along the lengthwise axis of the right plate portion 11R.

The treatment unit engagement portion 211 has, at the left, a treatment unit guide rail 211L and, at the right, a rack 211R. The treatment unit guide rail 211L is provided on a rear part of the side face of the left upright member 21L, and extends along the up-down axis, along the lengthwise axis of the upright member 21L. The treatment unit guide rail 211L guides the treatment unit 1021 when this moves. The rack 211R is provided on a rear part of the side face of the right upright member 21R, and extends along the up-down axis, along the lengthwise axis of the upright member 21R. The rack 211R is provided with, on its front side, a plurality of cogs that mesh with a pinion gear (omitted from illustration) in the treatment unit 1021. The treatment unit 1021 can, as the pinion gear rotates, move along the treatment unit guide rail 211L and the rack 211R.

The upper coupling portion 22 is provided between upper end parts of the upright members 21L and 21R, and couples these together. The upper coupling portion 22 is provided with an attachment member 220. The attachment member 220 extends rearward from the middle of the upper coupling portion 22 along the left-right axis. The lower coupling portion 23 is provided between lower end parts of the upright members 21L and 21R, and couples these together. The bridge portion 24 is U-shaped as seen along the up-down axis, and couples together middle parts of the upright members 21L and 21R along the up-down axis.

The arm treatment portion 3 is attached to and supported by the support frame 4, and can press side parts of the left and right forearms of the treated person seated on the massager 100. With the left arm treatment portion 3L, a side part of the left forearm of the treated person can be pressed. With the right arm treatment portion 3R, a side part of the right forearm of the treated person can be pressed.

Used as each of the arm treatment portions 3L and 3R in this embodiment is an air bag that inflates as air is supplied to it and that deflates as air is discharged from it. However, the treatment that each arm treatment portion 3 administer to a side part of the forearm of the treated person is not limited to massage; it can instead be any treatment using a physical means. Accordingly, the treatment that each arm treatment portion 3 administer to the side face of the left or right forearm of the treated person can be, for example, treatment in which heat is applied to a side part of the forearm or treatment in which electrical stimulus is applied to the treated part. Each arm treatment portion 3 can be configured as, for example, a treating element, an air bag, a vibrating element, a heater, an electrode pad, or the like used singly or in a combination of two or more of them.

The support frame 4 has a pair of, namely left and right, support portions 41L and 41R, a beam portion 42, and a bridge portion 43. The support portions 41L and 41R are occasionally referred to collectively as the "support portion(s) 41".

The support portions 41 are provided on the left and right sides, respectively, of the back frame 2, and support the arm treatment portions 3 respectively. The left support portion 41L is provided on the left side of the base portion 1. On the seat portion 101 side of the support portion 41L along the left-right axis, the arm treatment portion 3L is supported and fastened with an unillustrated fastening member. The right support portion 41R is provided on the right side of the base portion 1. On the seat portion 101 side of the support portion 41R along the right-right axis, the arm treatment portion 3R is supported and fastened with an unillustrated fastening member. In this embodiment, the support portion 41L supports the arm treatment portion 3L indirectly, and the support portion 41R supports the arm treatment portion 3R indirectly. This, however, is not meant as any limitation. The support portions 41L and 41R can instead directly support the arm treatment portions 3L and 3R respectively.

In this embodiment, each support portion 41 has a first frame member 411 and a second frame member 412. The first and second frame members 411 and 412 are each L-shaped. The first frame member 411 has an vertical portion that extends along the up-down axis and a horizontal portion that extends frontward from a lower end part of the vertical portion. The second frame member 412 has an vertical portion that extends along the up-down axis and a horizontal portion that extends rearward from an upper end part of the vertical portion. A front end part of the horizontal portion of the first frame member 411 is connected to a lower end part of the vertical portion of the second frame member 412. A rear end part of the horizontal portion of the second frame member 412 is connected to the vertical portion of the first frame member 411.

The beam portion 42 extends from upper-end parts of the support portions 41L and 41R toward the back frame 2 along the left-right axis. In other words, the beam portion 42 is provided between upper-end parts of the pair of, namely left and right, support portions 41L and 41R, and connects these together. A left end part of the beam portion 42 is connected to an upper end part of the left support portion 41L. A right end part of the beam portion 42 is connected to an upper end part of the right support portion 41R. The beam portion 42 is provided with an attachment member 420. The attachment member 420 extends rearward from the middle of the beam portion 42 along the left-right axis.

The bridge portion 43 is U-shaped as seen along the up-down axis, and couples together middle parts, along the up-down axis, of the pair of, namely left and right, support portions 41L and 41R. In this embodiment, the bridge portion 43 is arranged above the horizontal portion of the first frame member 411, and is arranged below the horizontal portion of the second frame member 412.

The support portion guide rail 51 guides the support portion 41 along the up-down axis. The left support portion guide rail 51L is provided on a rear part of the side face of the left plate portion 11L of the base portion 1, and extends along the up-down axis, along the lengthwise axis of the plate portion 11L. The right support portion guide rail 51R is provided on a rear part of the side face of the right plate portion 11R of the base portion 1, and extends along the up-down axis, along the lengthwise axis of the plate portion 11R. By being driven by the actuator 6, the pair of, namely left and right, support portions 41 can move along the support portion guide rails 51L and 51R.

For example, the support portion guide rail 51L movably engages with an engaged member (omitted from illustration) such as a roller provided in the support portion 41L, and the support portion guide rail 51R movably engages with an engaged member (omitted from illustration) such as a roller provided in the support portion 41R. The support portions 41, which can move by being driven by the actuator 6, can move along the up-down axis as a result of the engaged members, such as rollers, being guided along the up-down axis along the support portion guide rails 51.

The actuator 6 can move the support frame 4 relative to the back frame 2. The actuator 6 is provided above the treating unit 1021, and is provided, in particular, above the treating unit 1021 as it is moved to its uppermost position. Comparatively few mechanisms are disposed in the space above the treating unit 1021. It is thus possible to effectively use the space above the treating unit 1021 to arrange the actuator 6 without affecting the arrangement of other mechanisms.

The actuator 6 has a rod portion 61 in a columnar shape and a drive portion 62. A drive portion 62 side part of the rod portion 61 along its lengthwise axis can be accommodated inside the drive portion 62. The drive portion 62 drives the rod portion 61 to make the rod portion 61 expand and contract relative to the drive portion 62.

A beam portion 42 side end part of the rod portion 61 is pivotably coupled to the beam portion 42 via the attachment member 420. The drive portion 62 is pivotably supported on the upper coupling portion 22 of the back frame 2 via an attachment member 220. More specifically, an upper end part of the rod portion 61 is pivotably coupled to a rear end part of the attachment member 420, which is provided in a middle part of the beam portion 42. A lower end part of the drive portion 62 is pivotably supported on a rear end part of the attachment member 220, which is provided in a middle part of the upper coupling portion 22. Arranging the drive portion 62, which is heavier than the rod portion 61, below the rod portion 61 permits stable placement of the actuator 6. Moreover, it is then easier to attach the actuator 6 to the back frame 2 and the support frame 4.

The specific features described above are, however, not meant as any limitation. The drive portion 62 can be arranged above the rod portion 61. For example, the rod portion 61 can be pivotably supported on the attachment member 220 of the upper coupling portion 22. The drive portion 62 can be pivotably coupled to the attachment member 420 of the beam portion 42. In other words, the rod portion 61 can be pivotably connected to one of the upper coupling portion 22 of the back frame 2 or the beam portion 42 of the beam portion 42, and the drive portion 62 can be pivotably supported on the other of the upper coupling portion 22 or the beam portion 42 of the beam portion 42.

In this embodiment, the actuator 6 expands the rod portion 61 relative to the drive portion 62 to move the support frame 4 up relative to the back frame 2. This, however, is not meant as any limitation. It is also possible to contract the rod portion 61 and accommodate it inside the drive portion 62 to move the support frame 4 up relative to the back frame 2. This structure is obtained, for example, by arranging the beam portion 42 of the support frame 4 below the upper coupling portion 22 of the back frame 2.

In the first embodiment, as shown in FIGS. 5 and 6, as the rod portion 61 moves up, the support portion 41 of the support frame 4, along with the arm treatment portions 3, moves up along the support portion guide rails 51. As the rod portion 61 moves down, the support portion 41, along with the arm treatment portions 3, moves down along the support portion guide rails 51. Thus, under the drive of the actuator 6, the arm treatment portions 3, which can press side parts of the forearms of the treated person, can be moved along the up-down axis.

With this movement mechanism, the position of the arm treatment portions 3 and the support frame 4 along the up-down axis can be adjusted. For example, with air discharged to such an extent that the arm treatment portions 3L and 3R cannot hold the treated person between them or that they are completely deflated, the support frame 4 is moved along the up-down axis. In this way, it is possible to appropriately adjust the position along the lengthwise axis of the forearms of the treated person at which the sufficiently inflated arm treatment portions 3 make contact with side parts of the forearms.

For another example, with air supplied to the pair of, namely left and right, arm treatment portions 3L and 3R so that they are inflated simultaneously, moving the support frame 4 up permits the upper body (e.g., the left and right upper arms and the torso between them) of the treated person held between the arm treatment portions 3L and 3R to be lifted and moved upward. It is thus possible to administer stretching treatment to a mid-body part (e.g., the abdomen and the lower back) between the upper and lower body of the treated person.

Modified Example of the First Embodiment

In the first embodiment described previously, the upper end parts of the pair of, namely left and right, support portions 41L and 41R are coupled together by the beam portion 42; thus the support portions 41L and 41R are moved up and down together. In contrast, in a modified example, the support portions 41L and 41R can be moved up and down independently of each other. The following description focuses on those features of the modified example which make it different from the first embodiment. For such components as find their counterparts in the first embodiment, the same reference signs will be adhered to and overlapping description will often be omitted.

Figure 7:
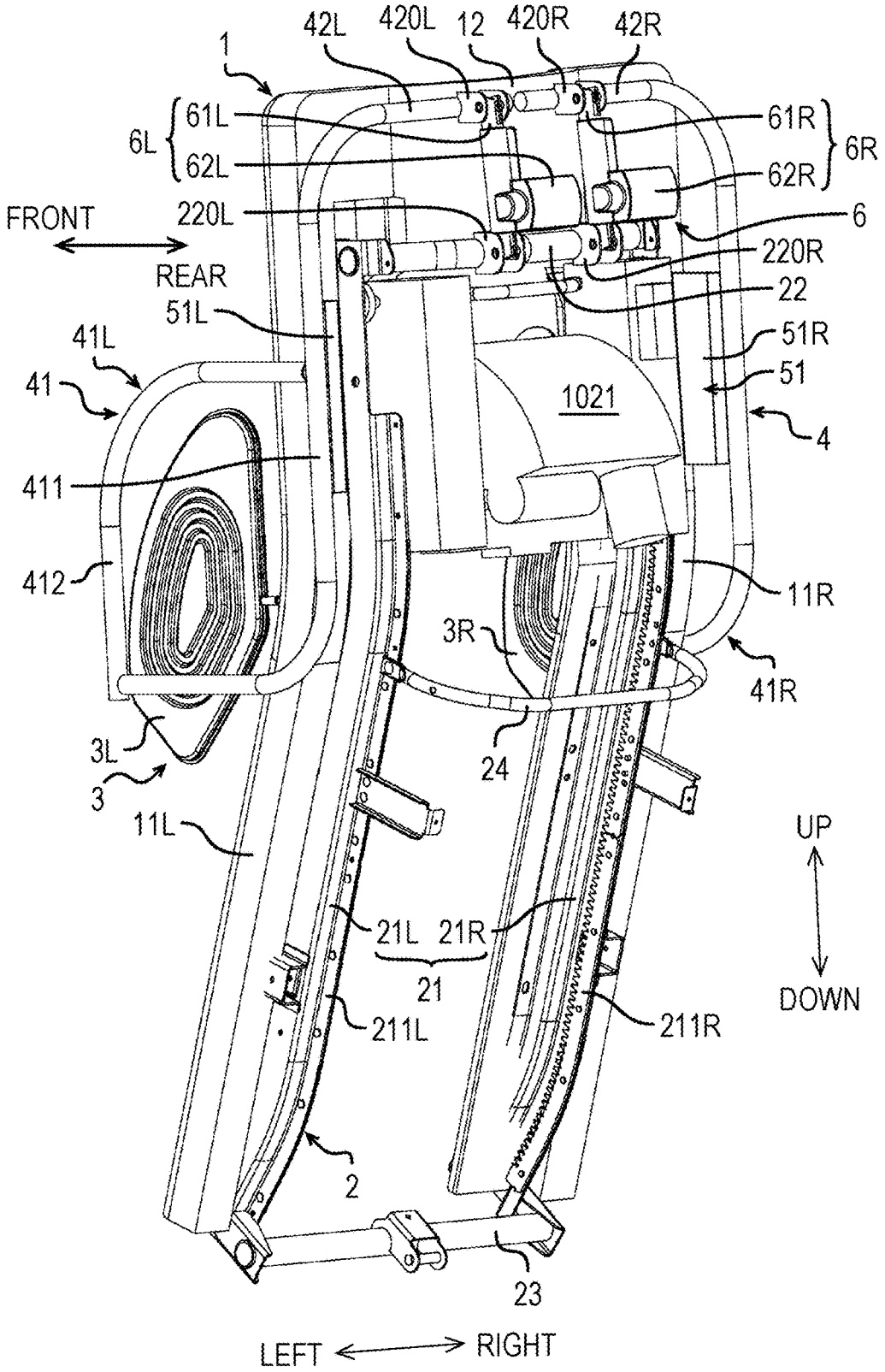
FIG. 7 is a perspective view of a principal part of a backrest portion according to a modified example of the first embodiment as seen from obliquely behind.

FIG. 7 is a perspective view of a principal part of the backrest portion 102 according to the modified example of the first embodiment. The indications "up", "down", "front", "rear", "left", and "right" in FIG. 7 indicate the respective directions with respect to the backrest portion 102 in the uncollapsed state.

As shown in FIG. 7, in a middle part of the upper coupling portion 22 of the back frame 2, two attachment portions 220L and 220R are provided. The attachment portions 220L and 220R extend rearward from the upper coupling portion 22.

The beam portion 42 of the support frame 4 has a first beam portion 42L and a second beam portion 42R.

The first beam portion 42L extends from an upper end part of one of the pair of support portions 41L and 41R toward the back frame 2 along the left-right axis. In FIG. 7, the first beam portion 42L extends rightward from an upper end part of the left support portion 41L. A right end part of the first beam portion 42L is provided with an attachment member 420L that extends rearward from the first beam portion 42L.

The second beam portion 42R extends from an upper end part of the other of the pair of support portions 41L and 41R toward the back frame 2 along the left-right axis. In FIG. 7, the second beam portion 42R extends leftward from an upper end part of the right support portion 41R. A left end part of the second beam portion 42R is provided with an attachment member 420R that extends rearward from the second beam portion 42R.

The actuator 6 has a first actuator 6L and a second actuator 6R. The first actuator 6L can move the support portion 41L and the first beam portion 42L of the support frame 4 relative to the back frame 2. The second actuator 6R can move the support portion 41R and the second beam portion 42R of the support frame 4 relative to the back frame 2.

The first actuator 6L has a rod portion 61L and a drive portion 62L. In FIG. 7, a first beam portion 42L side end part of the rod portion 61L is pivotably coupled to the first beam portion 42L via the attachment member 420L. A drive portion 62L side part of the rod portion 61L can be accommodated inside the drive portion 62L. The drive portion 62L is pivotably supported on the upper coupling portion 22 of the back frame 2 via an attachment member 220L. More specifically, an upper end part of the rod portion 61L is pivotably coupled to a rear end part of the attachment member 420L, which is provided in a middle part of the first beam portion 42L. Moreover, a lower end part of the drive portion 62L is pivotably supported on a rear end part of the attachment member 220L, which is provided in a middle part of the upper coupling portion 22.

The second actuator 6R has a rod portion 61R and a drive portion 62R. In FIG. 7, a second beam portion 42R side end part of the rod portion 61R is pivotably coupled to the second beam portion 42R via the attachment member 420R. A drive portion 62R side part of the rod portion 61R can be accommodated inside the drive portion 62R. The drive portion 62R is pivotably supported on the upper coupling portion 22 of the back frame 2 via an attachment member 220R. More specifically, an upper end part of the rod portion 61R is pivotably coupled to a rear end part of the attachment member 420R, which is provided in a middle part of the second beam portion 42R. Moreover, a lower end part of the drive portion 62R is pivotably supported on a rear end part of the attachment member 220R, which is provided in a middle part of the upper coupling portion 22.

The specific features shown in FIG. 7 are, however, not meant as any limitation. In the first actuator 6L, the rod portion 61L can be pivotably connected to one of the upper coupling portion 22 of the back frame 2 or the first beam portion 42L of the support frame 4. The drive portion 62L can be pivotably supported on the other of the upper coupling portion 22 or the first beam portion 42L. Additionally or alternatively, in the second actuator 6R, the rod portion 61R can be pivotably connected to one of the upper coupling portion 22 of the back frame 2 or the second beam portion 42R of the support frame 4. The drive portion 62R can be pivotably supported on the other of the upper coupling portion 22 or the second beam portion 42R.

In this modified example, as the rod portion 61L of the first actuator 6L expands and contracts, the left support portion 41L can, along with the left arm treatment portion 3L, move up and down along the left support portion guide rail 51L. Likewise, as the rod portion 61R of the second actuator 6R expands and contracts, the right support portion 41R can, along with the right arm treatment portion 3R, move up and down along the right support portion guide rail 51R. Moreover, the first and second actuators 41L and 41R can operate independently of each other. Thus, the support portions 41L and 41R can move up and down independently of each other.

With this movement mechanism, the position of the arm treatment portion 3L and the support portion 41L along the up-down axis and the position of the arm treatment portion 3R and the support portion 41R along the up-down axis can be adjusted separately. For example, with air discharged to such an extent that the arm treatment portions 3L and 3R cannot hold the treated person between them or that they are completely deflated, the support portions 41L and 41R are moved along the up-down axis independent of each other. In this way, it is possible to appropriately adjust independently of each other the positions along the lengthwise direction of the forearms of the treated person at which the sufficiently inflated arm treatment portion 3L makes contact with a side part of the left forearm and at which the sufficiently inflated arm treatment portion 3R makes contact with a side part of the right forearm.

For another example, with air supplied to the pair of, namely left and right, arm treatment portions 3L and 3R so that they are inflated simultaneously, moving up both of the support portions 41L and 41R permits the upper body (e.g., the left and right upper arms and the torso between them) of the treated person held between the arm treatment portions 3L and 3R to be lifted and moved upward. Meanwhile, by moving up and down the support portions 41L and 41R independently of each other as well, it is possible to bend a mid-body part (e.g., the abdomen and the lower back) between the upper and lower body of the treated person rightward and leftward. It is thus possible to administer more complex stretching treatment.

Second Embodiment

Next, a second embodiment will be described. In the second embodiment, a structure is adopted where the support frame 4 is pivotable about a rotation axis RA, which will be described later, that extends along the left-right axis. This makes it possible to administer treatment in which the upper body of the treated person is pressed against the backrest portion 102. The following description focuses on those features of the second embodiment which make it different from the first embodiment and its modified example. For such components as find their counterparts in the first embodiment and its modified example, the same reference signs will be adhered to and overlapping description will often be omitted.

Figure 8:
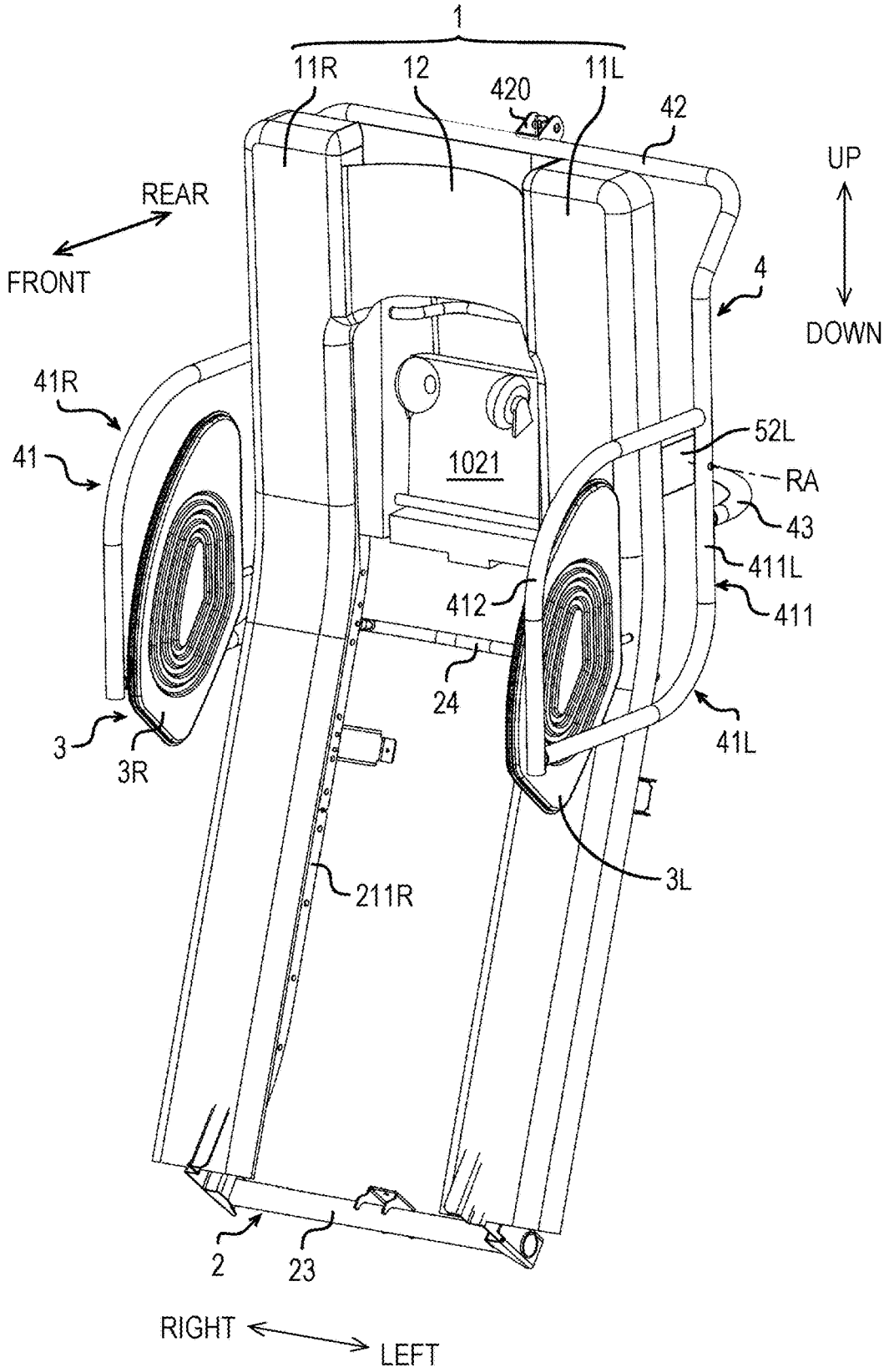
FIG. 8 is a perspective view of a principal part of a backrest portion provided in a chair-type massager according to a second embodiment as seen from obliquely in front.
Figure 9:
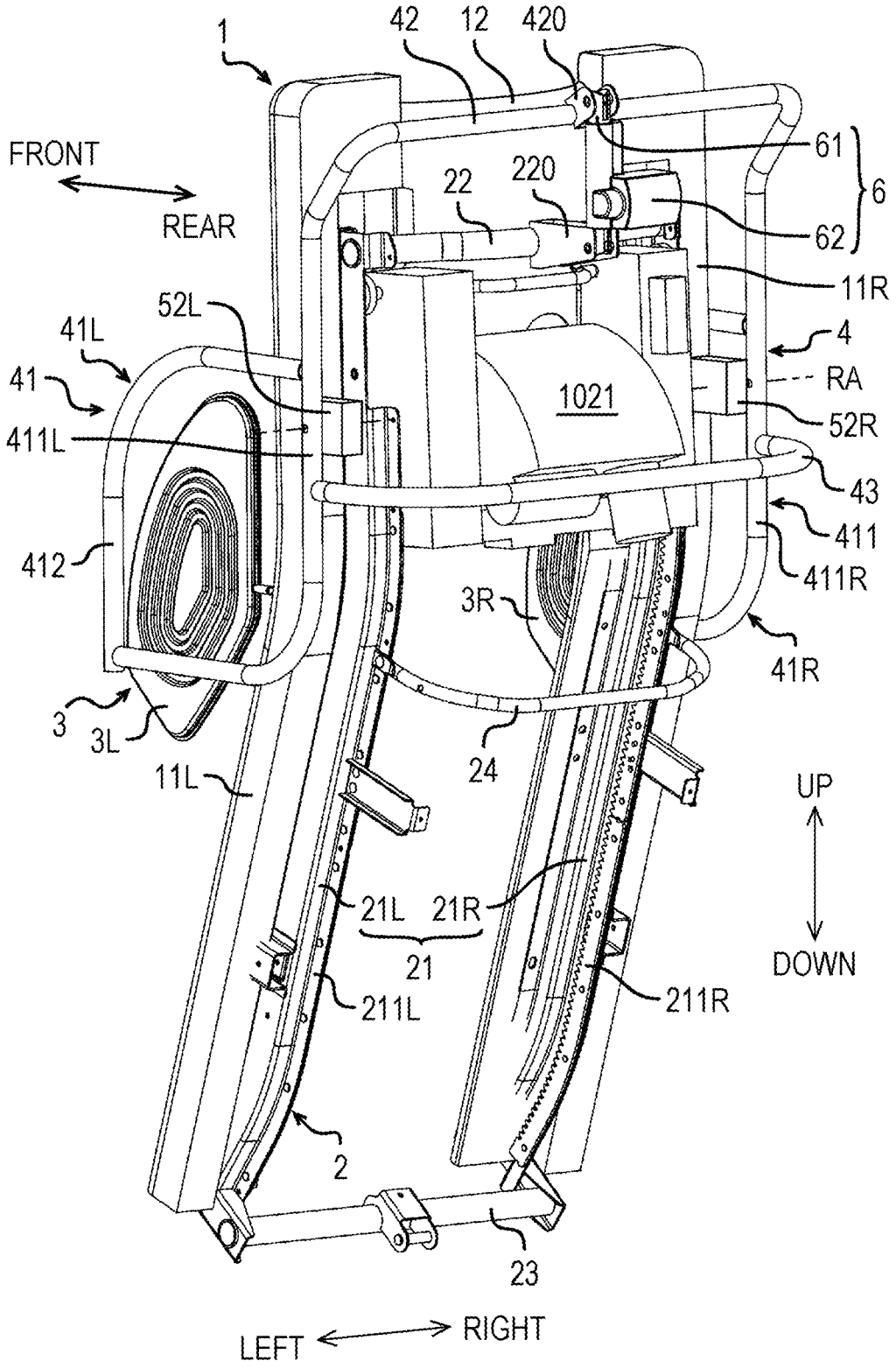
FIG. 9 is a perspective view of the principal part of the backrest portion according to the second embodiment as seen from obliquely behind.
Figure 10:
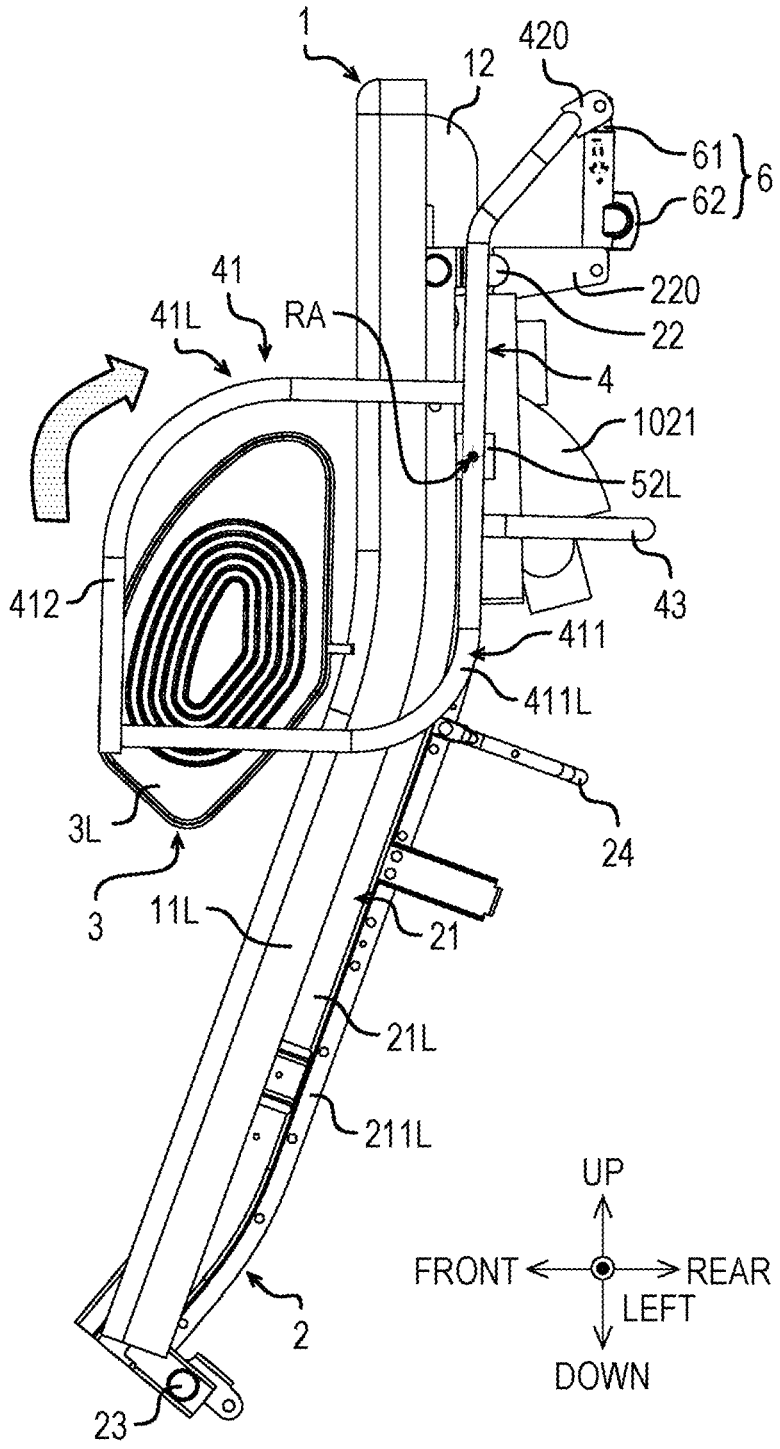
FIG. 10 is a side view showing an example of the operation of the principal part of the backrest portion according to the second embodiment.
Figure 11:
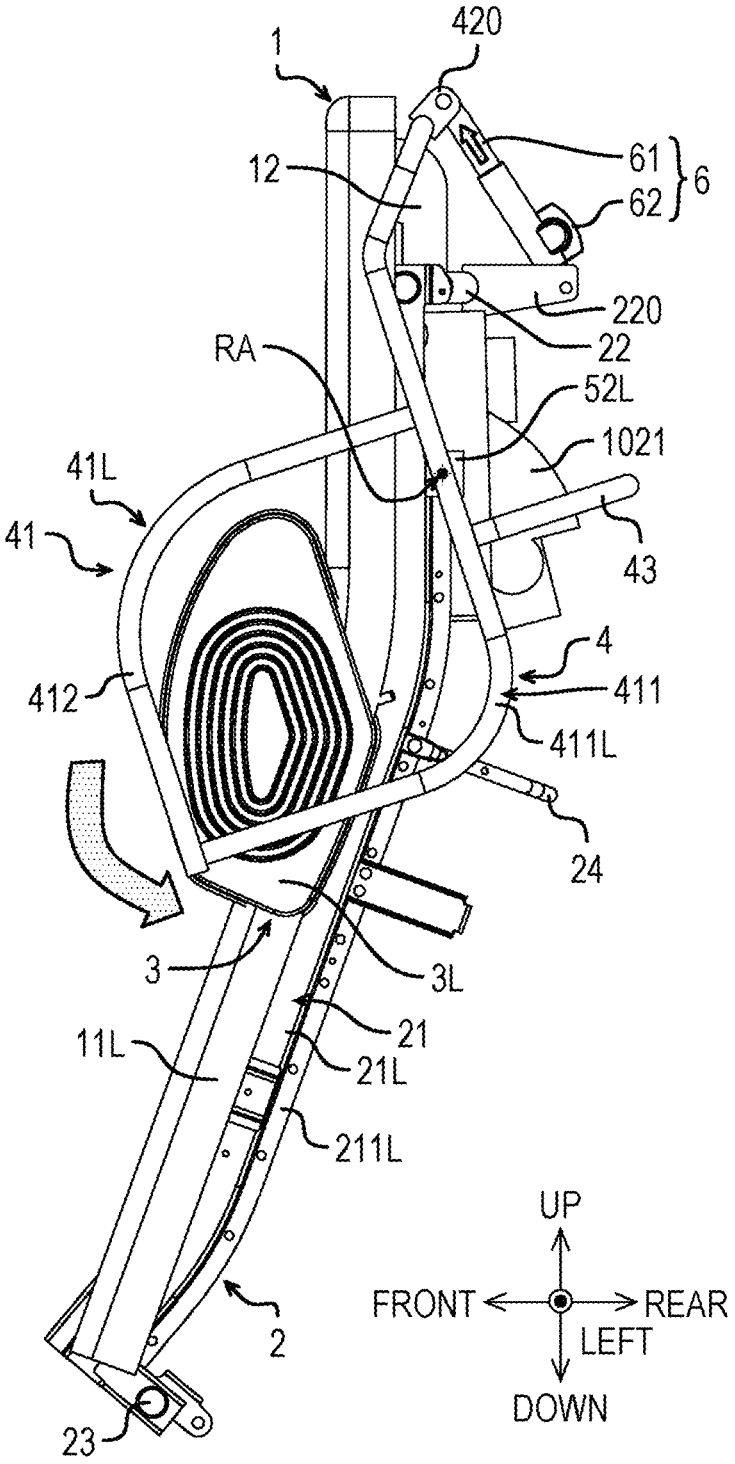
FIG. 11 is a side view showing another example of the operation of the principal part of the backrest portion according to the second embodiment.

FIGS. 8 to 11 are diagrams showing an example of the structure of a principal part of the backrest portion 102 according to a second embodiment. FIG. 8 is a perspective view of the principal part of the backrest portion 102 according to the second embodiment as seen from obliquely in front. FIG. 9 is a perspective view of the principal part of the backrest portion 102 according to the second embodiment as seen from obliquely behind. FIG. 10 is a side view showing an example of the operation of the principal part of the backrest portion 102 according to the second embodiment. FIG. 11 is a side view showing another example of the operation of the principal part of the backrest portion 102 according to the second embodiment. The indications "up", "down", "front", "rear", "left", and "right" in FIGS. 8 to 11 indicate the respective directions with respect to the backrest portion 102 in the uncollapsed state. FIGS. 10 and 11 show the left side of the principal part of the backrest portion 102 according to the second embodiment. FIG. 10 shows a state where the rod portion 61 of the actuator 6 is contracted. FIG. 11 shows a state where the rod portion 61 of the actuator 6 is expanded.

The backrest portion 102 includes a base portion 1 made of resin; a cushion portion (omitted from illustration); a back frame 2; a pair of, namely left and right, arm treatment portions 3L and 3R; a support frame 4; and an actuator 6, and additionally includes pivot portions 52L and 52R.

The pivot portions 52L and 52R pivotably support the support frame 4; in FIGS. 8 to 11, they pivotably support the vertical portions of the first frame members 411. The rotation axis RA extends along left-right axis, and passes, behind the base portion 1, through the vertical portion of the first frame member 411L of the support portion 41L and the pivot portion 52L and through the vertical portion of the first frame member 411R of the support portion 41R and the pivot portion 52R. The pivot portion 52L is provided to project from a rear part of the side face of the left plate portion 11L of the base portion 1, and supports, pivotably about the rotation axis RA, the first frame member 411L provided in the left support portion 41L. The pivot portion 52R is provided to project from a rear part of the side face of the right plate portion 11R of the base portion 1, and supports, pivotably about the rotation axis RA, the first frame member 411R provided in the right support portion 41R. By being driven by the actuator 6, the pair of, namely left and right, support portions 41 can pivot circumferentially about the rotation axis RA.

In the second embodiment, as the rod portion 61 expands, as shown in FIG. 11, the support frame 4 can, along with the arm treatment portion 3, pivot about the rotation axis RA counter-clockwise in FIG. 11. On the other hand, as the rod portion 61 contracts, as shown in FIG. 10, the support frame 4 can, along with the arm treatment portion 3, pivot about the rotation axis RA clockwise in FIG. 10. Thus, the arm treatment portions 3, which can press side parts of the forearms of the treated person, can be moved along the front-rear axis.

Thus, by making the support frame 4 pivot counter-clockwise in FIG. 11 with the left and right forearms of the treated person pressed by the pair of, namely left and right, arm treatment portions 3L and 3R (i.e., with the upper body held in between), it is possible to bend counter-clockwise the upper body of the treated person held between the arm treatment portions 3L and 3R and administer treatment in which the mid-body part (e.g., the lower back) between the upper and lower body is pressed against the backrest portion 102.

Furthermore, by making the support frame 4 pivot clockwise in FIG. 10 with the left and right forearms of the treated person pressed by the pair of, namely left and right, arm treatment portions 3L and 3R (i.e., with the upper body held in between), it is possible to bend clockwise the upper body of the treated person held between the arm treatment portions 3L and 3R and administer treatment in which the upper back and the shoulders of the treated person are pressed against the backrest portion 102. It is thus possible to administer novel, comfortable treatment.

It is also possible to appropriately adjust the position of the arm treatment portions 3 along the front-rear axis with respect to the treated person seated on the seat portion 101. For example, with the arm treatment portions 3L and 3R not holding the treated person between them, the support frame 4 is made to pivot circumferentially about the rotation axis RA. In this way, it is possible to appropriately adjust the position along the front-rear axis at which the arm treatment portions 3 make contact with side parts of the forearms. For example, by adjusting it to a position at which frontward parts of the side parts of the forearms are held between the arm treatment portions 3, it is possible, as the support frame 4 pivots, to press the mid-body part (e.g., the lower back) between the upper and lower body of the treated person harder against the backrest portion 102. For another example, by adjusting it to a position at which rearward parts of the side parts of the forearms are held between the arm treatment portions 3, it is possible, as the support frame 4 pivots, to press the upper back and the shoulders of the treated person harder against the backrest portion 102

As shown in FIGS. 8 to 11, in the support frame 4, an upper part of the L-shaped first frame member 411 bends rearward. The length over which the attachment member 220 provided on the upper coupling portion 22 of the back frame 2 extends from the upper coupling portion 22 is larger than the length over which the attachment member 420 provided on the beam portion 42 extends from the beam portion 42. With this design, as the rod portion 61 of the actuator 6 expands from the drive portion 62, the support portion 41 can pivot through a larger angle about the rotation axis RA. This makes it easier to administer treatment in which the mid-body part (e.g., the lower back) between the upper and lower body of the treated person, or his or her upper back and the shoulders, are pressed against the backrest portion 102.

As shown in FIGS. 8 to 11, the beam portion 42 of the support frame 4 is arranged above the upper coupling portion 22, and the rod portion 61 of the actuator 6 is arranged above the drive portion 62. This, however, is not meant as any limitation. The rod portion 61 can be arranged below the drive portion 62. The beam portion 42 can be arranged below the upper coupling portion 22.

Modified Example of the Second Embodiment

In the first embodiment described previously, upper end parts of the pair of, namely left and right, support portions 41L and 41R are coupled together via the beam portion 42, and thus both of the support portions 41L and 41R are made to pivot in the same direction circumferentially. In contrast, in the modified example, the left and right support portions 41L and 41R can be made to pivot in mutually different directions circumferentially. The following description focuses on those features of the modified example which make it different from the first embodiment, its modified example, and the second embodiment. For such components as find their counterparts in the first embodiment, its modified example, and the second embodiment, the same reference signs will be adhered to and overlapping description will often be omitted.

Figure 12:
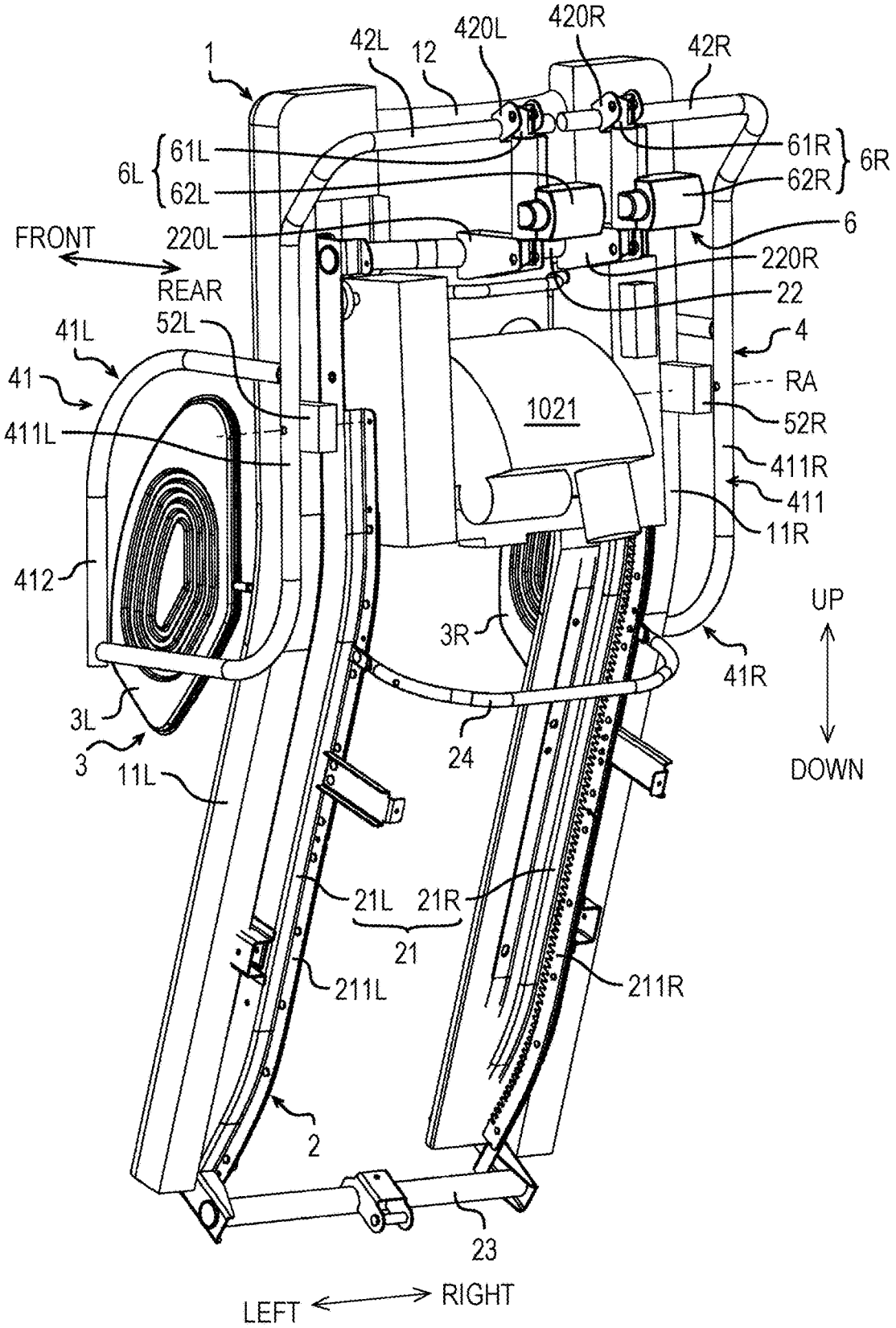
FIG. 12 is a perspective view of a principal part of a backrest portion according to a modified example of the second embodiment as seen from obliquely behind.

FIG. 12 is a perspective view of the backrest portion 102 according to the modified example of the second embodiment. The indications "up", "down", "front", "rear", "left", and "right" in FIG. 12 indicate the respective directions with respect to the backrest portion 102 in the uncollapsed state.

As shown in FIG. 12, in a middle part of the upper coupling portion 22 of the back frame 2, two attachment members 220L and 220R are provided. The attachment members 220L and 220R extend rearward from the upper coupling portion 22.

The beam portion 42 of the support frame 4 has a first beam portion 42L and a second beam portion 42R. The actuator 6 has a first actuator 6L and a second actuator 6R. The first actuator 6L can make the support portion 41L pivot by moving the first beam portion 42L of the support frame 4 relative to the back frame 2. The second actuator 6R can make the support portion 41R pivot by moving the second beam portion 42R of the support frame 4 relative to the back frame 2.

How the first and second actuators 6L and 6R are connected to the back frame 2 and to the support portion 41 and related features are generally the same as in the modified example of the first embodiment, and accordingly, as mentioned above, no overlapping description will be repeated.

In the modified example of the second embodiment, the support portions 41L and 41R can pivot independently of each other. Thus, for example, with the left and right forearms of the treated person pressed by the pair of, namely left and right, arm treatment portions 3L and 3R (i.e., with the upper body held in between), it is possible to make one of the support portions 41L and 41R pivot clockwise and the other of the support portions 41L and 41R pivot counterclockwise.

With this movement mechanism, it is possible to adjust independently of each other the position of the arm treatment portion 3L and the support portion 41L along the front-rear axis and the position of the arm treatment portion 3R and the support portion 41R along the front-rear axis. In this way, it is possible to adjust independently of each other the positions along the front-rear axis at which the sufficiently inflated arm treatment portions 3 make contact with the side parts of the forearms.

It is possible to administer treatment in which, at one side along the left-right axis, the mid-body part (e.g., the abdomen, the lower back) between the upper and lower body of the treated person is pressed against the backrest portion 102 while, at the other side along the left-right axis, the shoulder and the upper back of the treated person is pressed against the backrest portion 102. It is thus possible to administer more complex treatment.

In FIG. 12, the support portions 41L and 41R pivot about the same rotation axis RA. This, however, is not meant as any limitation. The support portions 41L and 41R can have mutually different rotation axes. In that case, the rotation axis of the pivoting support portion 41L extends along the left-right axis, and passes, behind the base portion 1, through the vertical portion of the first frame member 411L of the support portion 41L and through the pivot portion 52L; the rotation axis of the pivoting support portion 41R extends along the left-right axis, and passes, behind the base portion 1, through the vertical portion of the first frame member 411R of the support portion 41R and through the pivot portion 52R.

Overview

According to what is disclosed herein, a chair-type massager 100 includes: a seat portion 101 supporting the buttocks and thighs of a treated person; and a backrest portion 102 disposed generally upright from the seat portion 101 and supporting the body (torso) of the treated person. The backrest portion 102 has: a back frame 2 as the framework of the backrest portion 102; a pair of arm treatment portions 3 configured to press side parts of the left and right forearms of the treated person; a support frame 4 having a pair of support portions 41, the support portions 41 being provided on the left and right sides, respectively, of the back frame 2 and supporting the arm treatment portions 3 respectively; and an actuator 6 configured to move the support frame 4 relative to the back frame 2. The support frame 4 further has a beam portion 42 extending from upper end parts of the support portions 41 toward the back frame 2 along the left-right axis. The actuator 6 has: a rod portion 61 connected to one of the back frame 2 or the beam portion 42 of the support frame 4; and a drive portion 62 pivotably supported on the other of the back frame 2 or the beam portion 42 of the support frame 4, the drive portion 62 being configured to move up and down the rod portion 61. (A first configuration.)

In the chair-type massager 100 of the first configuration described above, preferably, the backrest portion 102 has a guide rail 211 extending along the up-down axis, and the support portions 41 are movable along the guide rail 211 by being driven by the actuator 6. (A second configuration.)

Alternatively, in the chair-type massager 100 of the first configuration described above, preferably, the backrest portion 102 further has pivot portions 52L and 52R supporting the support frame 4 pivotably about a rotation axis RA extending along the left-right axis. (A third configuration.)

In the chair-type massager 100 of any of the first to third configurations described above, preferably, the beam portion 42 of the support frame 4 has: a first beam portion 42L extending from the upper end part of one of the pair of support portions 41 toward the back frame 2 along the left-right axis; and a second beam portion 42R extending from the upper end part of the other of the pair of support portions 41 toward the back frame 2 along the left-right axis. Preferably, the actuator 6 has: a first actuator 6L configured to move the first beam portion 42L of the support frame 4 relative to the back frame 2; and a second actuator 6R configured to move the second beam portion 42R of the support frame 4 relative to the back frame 2. (A fourth configuration.)

In the chair-type massager 100 of any of the first to fourth configurations described above, preferably, the backrest portion 102 further has a treating unit 1021 supported by the back frame 2 and configured to administer treatment to the back of the treated person. Preferably, the actuator 6 is arranged above the treating unit 1021. (A fifth configuration.)

With the chair-type massager 100 according to any of the first to fifth configurations described above, it is possible to provide a concrete movement mechanism for an arm treatment portion 3 configured to press a side part of the forearm of a treated person.

As would be clear to those skilled in the art, the embodiments by way of which the present invention is described above are merely illustrative and allow for various modifications, in terms of the combination of constituent elements and processes, that fall within the scope of the present invention.

What is claimed is:

1. A chair-type massager comprising:

a seat portion supporting buttocks and thighs of a treated person; and a backrest portion disposed generally upright from the seat portion and supporting the body of the treated person, wherein the backrest portion has:

a back frame as a framework of the backrest portion;

a pair of arm treatment portions configured to press side parts of left and right forearms of the treated person;

a support frame having a pair of support portions, the support portions being provided on left and right sides of the back frame respectively and supporting the arm treatment portions respectively; and an actuator configured to move the support frame relative to the back frame, the support frame further has a beam portion extending from upper end parts of the support portions toward the back frame along a left-right axis, and the actuator has:

a rod portion connected to one of the back frame or the beam portion of the support frame; and a drive portion pivotably supported on one of the back frame or the beam portion of the support frame, the drive portion being configured to move up and down the rod portion.

2. The chair-type massager according to claim 1, wherein the backrest portion has a guide rail extending along an up-down axis, and the support portions are movable along the guide rail by being driven by the actuator.

3. The chair-type massager according to claim 1, wherein the backrest portion further has pivot portions supporting the support frame pivotably about a rotation axis extending along the left-right axis.

4. The chair-type massager according to claim 1, wherein the beam portion of the support frame has:

a first beam portion extending from the upper end part of one of the pair of support portions toward the back frame along the left-right axis; and a second beam portion extending from the upper end part of another of the pair of support portions toward the back frame along the left-right axis, and the actuator has:

a first actuator configured to move the first beam portion of the support frame relative to the back frame; and a second actuator configured to move the second beam portion of the support frame relative to the back frame.

5. The chair-type massager according to claim 1, wherein the backrest portion further has a treating unit supported by the back frame and configured to administer treatment to a back of the treated person, and the actuator is arranged above the treating unit.

* * * * *